US005117506A

United States Patent [19]

Byrnes et al.

[11] Patent Number: 5,117,506

[45] Date of Patent: Jun. 2, 1992

[54] PROTECTIVE HELMET

[75] Inventors: James K. Byrnes, Pittsburgh; Glenn C. Davis, Apollo, both of Pa.

[73] Assignee: Mine Safety Appliances Company, Pittsburgh, Pa.

[21] Appl. No.: 699,644

[22] Filed: May 14, 1991

[51] Int. Cl.[5] ..... A42B 1/00; A42B 1/06

[52] U.S. Cl. ..... 2/10; 2/7; 2/8; 2/12; 2/177; 2/178; 2/185 R; 2/186; 2/191; 2/192; 2/195; 2/199; 2/411; 2/412; 2/414

[58] Field of Search ..... 2/2, 5, 6, 7, 8, 10, 2/411, 12, 177, 185 R, 199, 200, 205, 206, 190, 191, 412, 413, 414, 186, 192, 178

[56] References Cited

U.S. PATENT DOCUMENTS

| | | | |
|---|---|---|---|
| 3,787,109 | 1/1974 | Vizenor | 2/6 X |
| 3,849,801 | 11/1974 | Holt et al. | 2/413 |
| 4,220,400 | 9/1980 | Vizenor | 2/424 X |
| 4,766,565 | 10/1973 | Cozzens | 2/200 |

*Primary Examiner*—Werner H. Schroeder
*Assistant Examiner*—Jeanette E. Chapman

[57] ABSTRACT

A protective hat comprises a shell having a visor in which the underside of the visor is molded with a textured surface that diffuses reflected light.

1 Claim, 1 Drawing Sheet

PROTECTIVE HELMET

FIELD OF THE INVENTION

This invention relates to protective helmets and more particularly to such helmets made of plastic materials with smooth, reflective surfaces.

BACKGROUND OF THE INVENTION

Protective hats and caps for workers conventionally comprise a plastic shell and an energy absorbing liner. The shells include an outwardly extending visor or brim that shades the wearer's eyes. The plastics, conventionally polycarbonate or polyethylene, can reflect glare from sunlight or artificial light up onto the underside of the visor or brim and into the wearer's eyes. Such glare is presently reduced by painting the underside of the brim with a flat green paint or covering it with flat green paper having a pressure-sensitive adhesive. Each of these methods is an extra operation, resulting in additional cost.

SUMMARY OF THE INVENTION

In accordance with this invention, the underside of the visor or brim of a protective helmet is molded with a textured surface that diffuses reflected light, thereby diminishing reflectance into the wearer's eyes. The improvement is obtained at substantially no cost.

PREFERRED EMBODIMENT OF THE INVENTION

Figure 1:
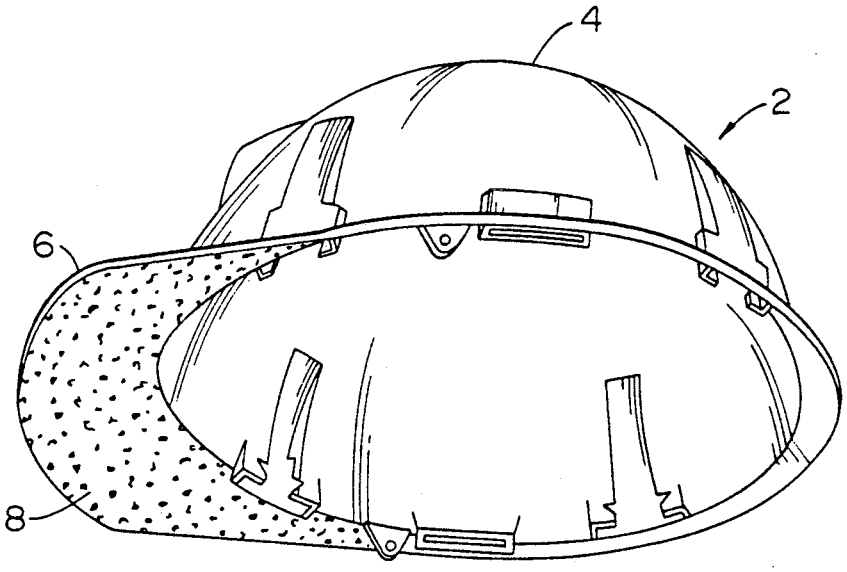
FIG. 1 is a perspective view of a helmet shell of this invention.

With reference to FIG. 1, a protective helmet comprises a shell 2 having a crown portion 4 and a visor portion 6. The underside 8 of the visor 6 is molded with a textured surface that diffuses reflected light. The texture extends over the entire underside of the visor and is preferably fine grained to provide a high degree of diffusion. Helmets having a full brim may have the entire underside of the brim textured or only that portion of the brim extending over the eyes.

A now preferred texture is Akron Metal Etching Texture E908. Comparative reflectance tests on green and white polycarbonate hats showed the molded textured surface was equally effective at preventing glare as the prior art flat paint or paper. Reflection of the visor underside measured using a Mallinckrodt 60° pocket gloss meter was as follows:

| Surface | Gloss Range |
|---|---|
| Green Untextured | 62–79 |
| White Untextured | 92–94 |
| Green Textured | 3.6–4.2 |
| White Textured | 4.9–5.5 |
| Green Painted | 3.4–4.5 |
| Green Paper | 10.7–11.7 |

We claim:

1. A protective hat comprising a shell formed from a plastic with a reflective surface and having a visor portion shading the eyes, the underside of said visor portion being molded with a textured surface that diffuses reflected light.

* * * * *